US008678254B2

(12) United States Patent
Murphy

(10) Patent No.: US 8,678,254 B2
(45) Date of Patent: Mar. 25, 2014

(54) BELT WITH DEPENDENT STRAP LOOPS FOR RECEIVING PINCHERS

(76) Inventor: Randolph C. Murphy, Ithaca, NY (US)

( * ) Notice: Subject to any disclaimer, the term of this patent is extended or adjusted under 35 U.S.C. 154(b) by 876 days.

(21) Appl. No.: 11/877,332

(22) Filed: Oct. 23, 2007

(65) Prior Publication Data

US 2009/0100644 A1 Apr. 23, 2009

(51) Int. Cl.
*A45F 5/00* (2006.01)

(52) U.S. Cl.
USPC ..... 224/157

(58) Field of Classification Search
USPC ..... 224/157, 240, 250, 262, 271, 660, 662, 224/663, 184, 646; 294/15, 16, 164, 118
See application file for complete search history.

(56) References Cited

U.S. PATENT DOCUMENTS

| | | | | |
|---|---|---|---|---|
| 87,844 | A * | 3/1869 | Hale | 294/118 |
| 707,610 | A * | 8/1902 | Moeller | 224/157 |
| 2,651,441 | A * | 9/1953 | Rau et al. | 224/259 |
| 4,396,091 | A * | 8/1983 | Anderson | 182/3 |
| 5,501,379 | A * | 3/1996 | Munoz | 224/240 |
| 5,941,438 | A * | 8/1999 | Price | 224/662 |
| 7,007,832 | B1 * | 3/2006 | Payne | 224/660 |
| 2006/0289574 | A1 * | 12/2006 | Cacioppo, Jr. | 224/162 |

FOREIGN PATENT DOCUMENTS

| | | | | |
|---|---|---|---|---|
| GB | 2224193 | A * | 5/1990 | A45F 3/14 |

OTHER PUBLICATIONS

Granite City Tool—Stone Pro Carry Clamps 2507-0020, Oct. 22, 2007; www.granitecitytool.com/ showitem.cfm?itemnum= 85& catnum=115& pcatnum=115&mcatnum=93.

* cited by examiner

*Primary Examiner* — Adam Waggenspack
(74) *Attorney, Agent, or Firm* — Brian B. Shaw, Esq.; Harter Secrest & Emery LLP

(57) ABSTRACT

The present invention broadly comprises a support belt having a band including a first end having a fastener, a second end configured to receive the fastener and a middle portion having a midpoint and arranged between the first and second ends. The present invention also includes a first dependent loop coupled to the first end of the band and a second dependent loop coupled to the second end of the band, wherein the first and second dependent loops are disposed at a predetermined angle to the band.

16 Claims, 4 Drawing Sheets

BELT WITH DEPENDENT STRAP LOOPS FOR RECEIVING PINCHERS

CROSS-REFERENCE TO RELATED APPLICATIONS

None.

STATEMENT REGARDING FEDERALLY SPONSORED RESEARCH OR DEVELOPMENT

None.

REFERENCE TO A "SEQUENCE LISTING"

None.

TECHNICAL FIELD

The present invention relates to belts for lifting and carrying large amounts of weight. More specifically, the present invention is related to belts that secure conventional pinching and/or clamping devices and to belts that allow a carrier (user) to utilize their legs, rather than their back, to lift heavy objects.

BACKGROUND OF THE INVENTION

Heavy and bulky slab materials, such as natural stone, tile, ceramics and glass, are often used in the construction of homes and commercial buildings. These materials can weigh as much as five hundred to six hundred pounds and traditionally take four to six men to carry and install. Further, wide slabs of these materials must be carried vertically to prevent the material from breaking. Pinchers were recently introduced to assist users in carrying the slabs of material vertically, to more evenly distribute the weight of the heavy materials between users and to reduce the amount of strain on individuals. The pincher handles are gripped in the hands of the user and are held near the front-middle of the torso.

A problem with pinchers is that it requires carriers to rely heavily on their backs and arms to carry heavy object. Thus, carriers often suffer from severe back pain and are subject to muscle strains of their biceps, triceps, deltoids, Latissimus dorsi and other arm and back muscles. Further, serious and even permanent back injuries sometimes occur, including painful herniated disks and compression fractures.

What is needed, then, is an apparatus that will distribute the weight of heavy loads to the legs of the carrier rather than their back and arms. An apparatus that will reduce the cost of labor for the movement of heavy, bulky materials is also needed.

SUMMARY OF THE INVENTION

The present invention broadly comprises a support belt having a band including a first end having a fastener, a second end configured to receive the fastener and a middle portion having a midpoint and arranged between the first and second ends. A first dependent loop is coupled to the first end of the band and a second dependent loop is coupled to the second end of the band. The first and second dependent loops are disposed at a predetermined angle to the band.

The present invention also comprises a band having a first end, a second end, a fastener for removably securing the first and second ends and a middle portion disposed between the first and second ends and having a midpoint. A first dependent loop is coupled to the first end of the band and a second dependent loop is coupled to the second end of the band. Each dependent loop is disposed at a predetermined angle from the band.

The present invention further comprises a support belt comprising a band including a first end having a fastener and a second end configured to receive the fastener. The band includes a middle portion arranged between the first and second ends and having a midpoint. The strap includes a first dependent loop and a second dependent loop. The strap is parallely disposed at least along the middle portion of the band, and the first and second dependent loops are disposed at a predetermined angle to the band.

Another embodiment of the invention includes a support belt comprising a band including a first end having a fastener and a second end configured to receive the fastener. Preferably, the embodiment also includes a first dependent loop coupled to the first end of the band and a second dependent loop coupled to the second end of the band, wherein the first and second dependent loops are disposed at a predetermined angle to the band. A pincher having self-locking first and second handles is disposed in the first and second dependent loops.

BRIEF DESCRIPTION OF THE DRAWING FIGURES

DETAILED DESCRIPTION OF THE INVENTION

Figure 1:
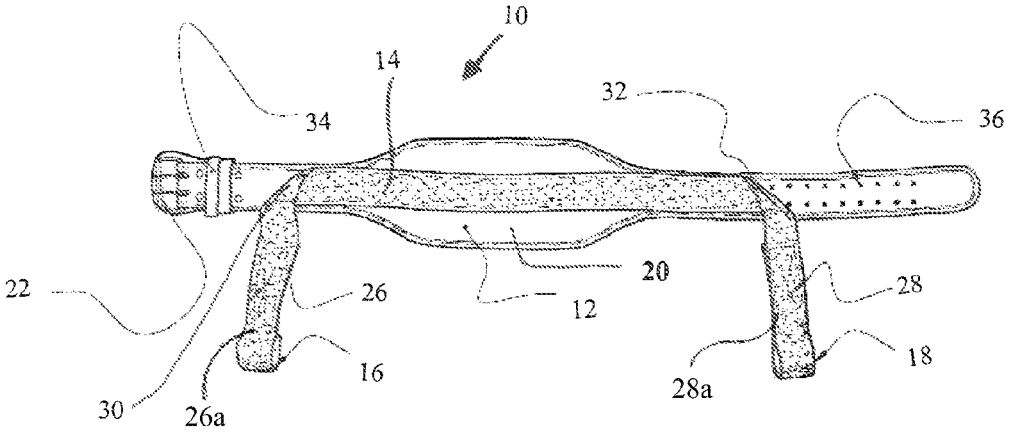
FIG. 1 is a top view of a belt with dependent strap loops.
Figure 2:
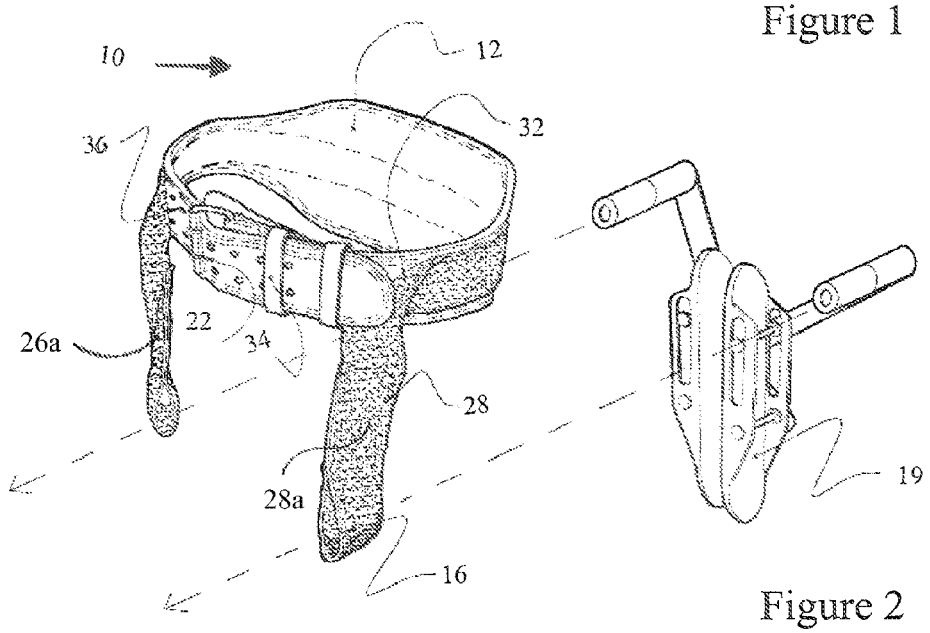
FIG. 2 is a perspective view of the belt showing pinchers being aligned for inserting into the dependent strap loops.

At the outset, it should be appreciated that the use of the same reference number throughout the several figures designates a like or similar element. Referring now to the figures, FIGS. 1-2 show a belt 10 comprises a band 12 and an overlapping strap 14 having a first loop 16 and a second loop 18 for receiving handles of a pincher 19, as shown in FIG. 2.

The pincher 19 is commercially available at Granite City Tool and is sold under the name Stone Pro Carry Clamps, Item # 2507-0020. The Stone Pro Carry Clamps can be purchased from the following website: http://www.granitecitytool.com/showitem.cfm?itemnum=85&catnum=115&p catnum=115&mcatnum=93. The pincher 19 is operatively arranged to be self-locking, wherein the pincher 19 grips the slab of material more tightly as the force exerted on the pinchers increases. That is, when the user pivots the handles of the pincher 19 downwardly, towards the ground, the jaws of the pincher 19 open enabling the pincher 19 to receive the slab of material. When the user pivots the handles of the pinchers 19 upwardly, the jaws of the pincher 19 clamp the slab of material. The greater the force exerted upwardly on the handles of the pincher 19 by the user and the greater the force exerted downwardly on the jaws of the pincher 19 by the extreme weight of the slab of material, the more tightly the jaws of the pincher 19 clamp the slab of material.

The band 12 is preferably made of leather however other materials known in the art, such as nylon webbing and synthetic leather may be used. For integrity purposes, the band 12 is preferably double stitched around the entire perimeter. In an embodiment of the invention, the overlapping strap 14 is centrally positioned and affixed to outer surface of the band 12. In an alternative embodiment of the invention, the strap 12 is affixed to the inner surface of the band 12. By "outer surface" of the band 12, it is meant the top view shown in FIG. 1. By "inner surface" of the band 12, it is meant the surface that is in contact with the body when the belt is worn. Although the strap 14 is shown sewn to the band 10, it should be appreciated that the strap 14 can be affixed to the belt using other means, including, but not limited to by a strong adhesive and/or rivets.

The belt 10 further preferably includes a widest portion 20, a buckle end 22, and an opposite end 24. The first and second loops 16, 18 include strap ends 26, 28 connected to the strap 14, wherein the strap ends 26, 28 are perpendicular to the band 12. In one embodiment, a substantial portion of the strap 14 is affixed to the band 12 and the strap ends 26, 28 are independent from the band 12. The strap 14 can be, however, integrally connected to the band 12. The strap ends 26, 28 are folded downwardly at approximately a 45 degree angle, wherein folded regions 30, 32 are permanently secured. The folded regions 30, 32 can be sewn together along the folded portion, adhered together, or secured with rivets or other means. It should be apparent that the folded regions 30, 32 can be folded at other angles, for example, in the range of 15 degrees to 90 degrees, and this modification is intended to be within the spirit and scope of the invention as claimed. As seen in FIGS 1, 2, 3 and 4, the attachment of the straps 26, 28 to the belt at the folded regions 30, 32 is at an anterior portion of the user. That is, the straps 26, 28 depend from an anterior portion of the belt 10.

Each loop 16, 18 may be formed by affixing a terminal end of each the independent section of the strap ends 26, 28 to an upper portion of the strap ends 26, 28. That is, the strap ends 26, 28 are each folded upwardly onto themselves and the upper portion of each strap end 26, 28 is affixed. The lower portion of the strap ends 26, 28 remains unattached, forming a loop for receiving the pincher handles. Referring to FIGS. 1, 2, 3, 4 and 5, each strap thus has a spacer portion 26*a*, 28*a* intermediate the folded region 30, 32 and the loops 16, 18.

Figure 3:
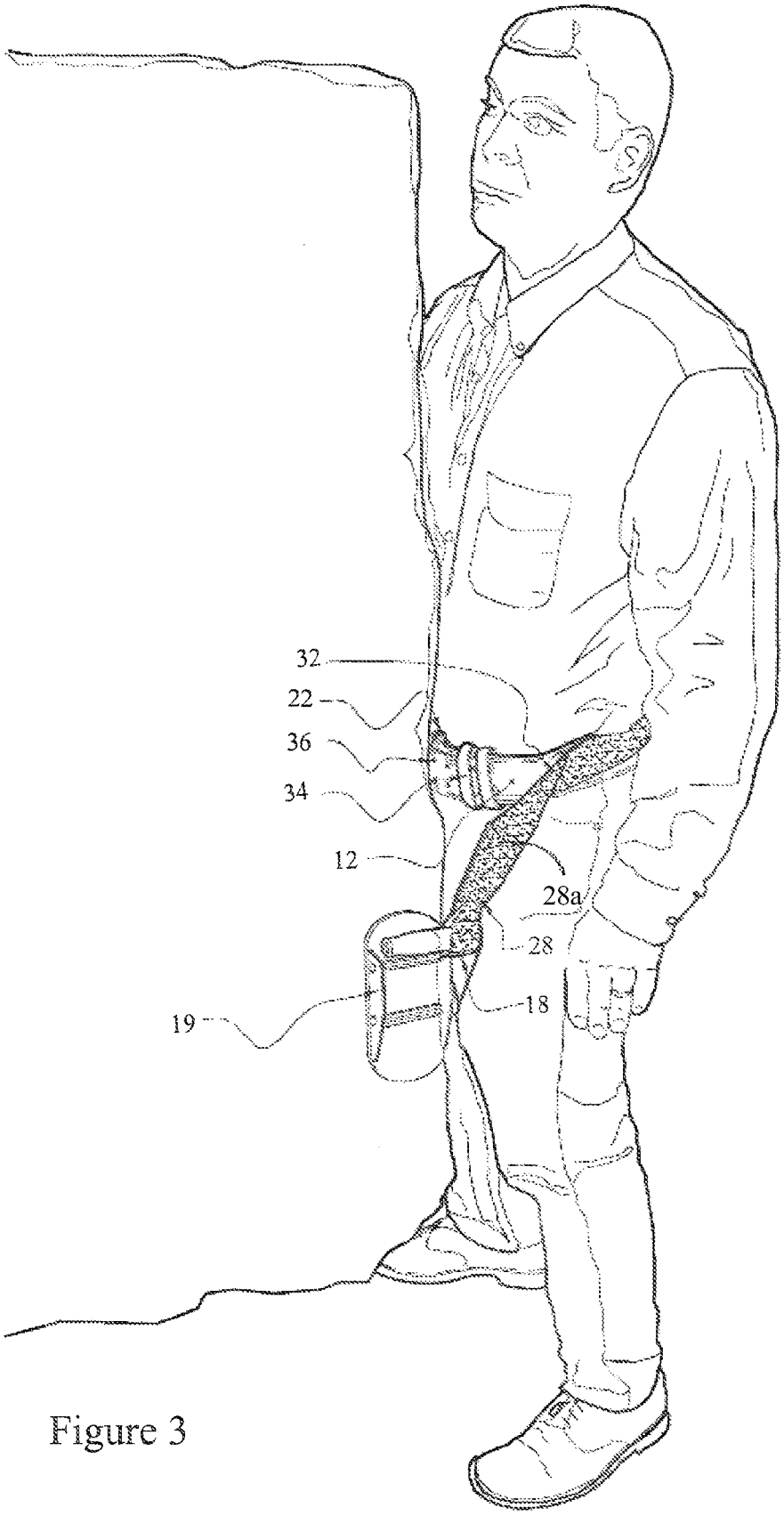
FIG. 3 is a perspective view of a person wearing the belt with pinchers inserted into the dependent strap loops to carry a heavy object.

As shown in FIGS. 1-3, a tapered flap 33 can be connected to the buckle end 22 of the belt 10. In a preferred embodiment, the top portion of the tapered flap 33 is connected to the buckle end 22 and is approximately six inches wide. The tapered flap 33 extends approximately three to four inches below the band 12 and protects the groin area of the carriers. Preferably, the tapered flap 33 is made of protective leather, although other materials, including but not limited to nylon webbing, canvas, and heavy vinyl can be used. Preferably, the buckle 22 is dual-pronged metal connected by rolled-over leather 34 attached with four to six rivets and double stitched. Preferably, the band 10 includes aligned sets of two holes 36, preferably spaced at 1¼ inches, on the belt end 24 to receive the dual-pronged metal buckle 22.

Figure 4:
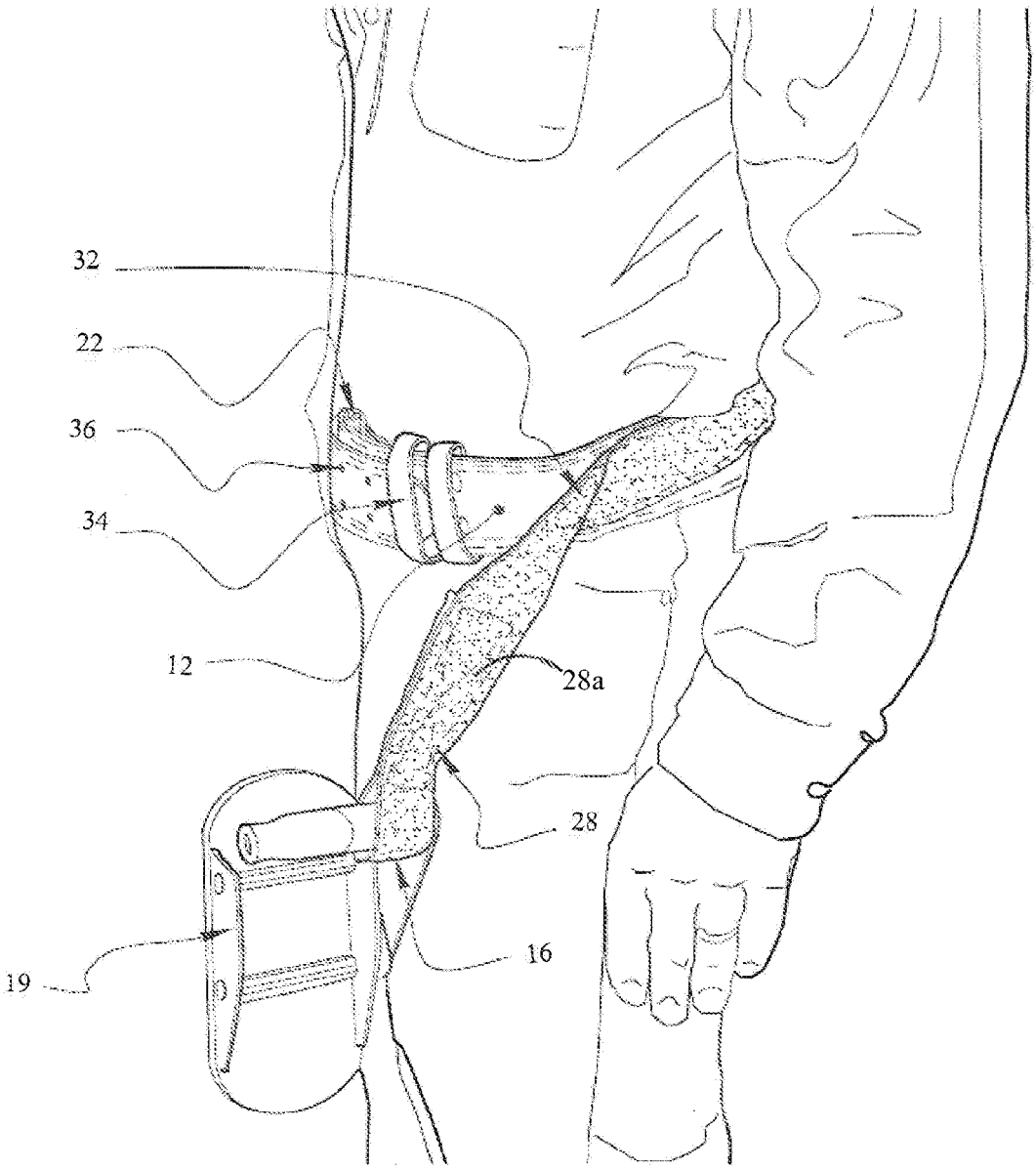
FIG. 4 is a perspective view, similar to FIG. 3, except showing a closer view of the belt having pinchers inserted into the dependent strap loops.

In use, as shown in FIGS. 3 and 4, a first carrier and a second carrier each fasten belts 10 tightly around their upper hip portion of their torso. Handles of pinchers 19 are inserted through the loops 16, 18 of the strap 14, wherein the handles of the pinchers 19 point away from the body of each carrier. The two carriers squat and place the pinchers on the lower portion of a slab of heavy material. Then the carriers simultaneously and slowly press upwardly using their legs for the lifting power. As the carriers begin to stand, the pincher handles automatically pivot inwardly towards the middle of the torsos of the carriers such that the pinchers firmly grip the slab of heavy material. Once the carriers reach a full standing position, the slab of heavy material is held off the ground, with the belts 10 and lower bodies of the carriers bearing the weight of the slab. Thus, only two men are required to lift the heavy slab of material saving labor costs. Further, the legs of the carriers are utilized, saving the backs of the carriers from severe injury. In addition, the hands of the carriers are available for negotiating doorways, hallways and the like, as well as for helping the carriers maintain their balance.

Figure 5:
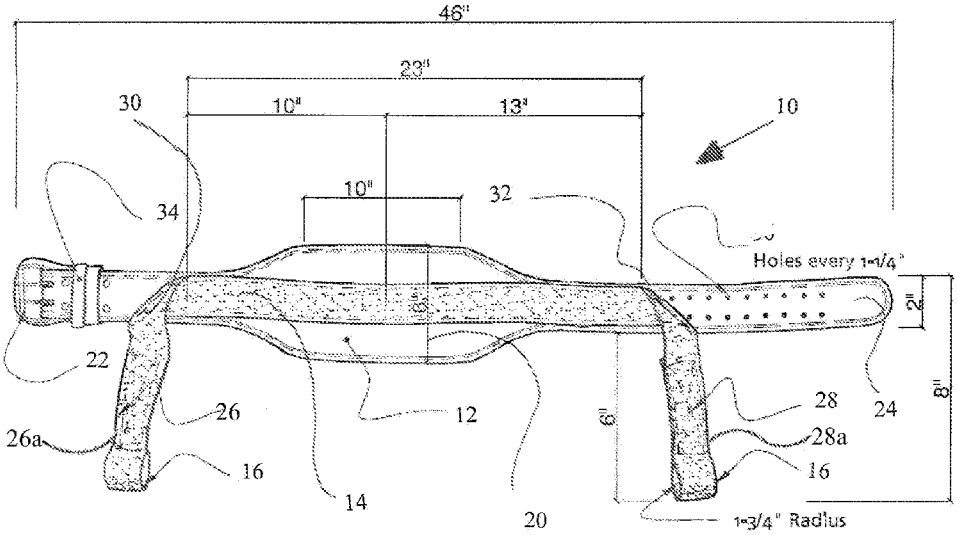
FIG. 5 is a top view of the belt showing measurements of an embodiment of the belt.

FIG. 5 shows an embodiment of the belt 10 and measurements related thereto. It should be appreciated by those having ordinary skill in the art that the size of the belt may vary and thus, the distance from the center of the belt to the folded regions 30, 32 may vary. Preferably, the first and second loops 16, 18 are disposed approximately equidistant from the midpoint of the band. More preferably, the distance from the center of the band 12, or the midpoint, to the folded region 30 of the first loop 16 is shorter than the distance from the center of the band 12 to the folded region 32 of the second loop 18. For example, as shown in FIG. 5, the distance from the midpoint of the band 12 to the first loop 16 is ten inches and the distance from the center of the band 12 to the folded region 32 of the second loop 18 is thirteen inches. Similar proportions can be used for other belt sizes. In a preferred embodiment, the strap 14 has a width of at least two inches.

In an embodiment of the invention, the loops 16, 18 have a diameter of approximately two inches. It should be appreciated that the diameter of the loops need only be large enough to accommodate the size of the pincher handles. Further, the band 12 has a width of at least three inches. More preferably, the band 12 includes a wider center portion, wherein the widest portion 20 of the band 12 is in the range of six to ten inches, preferably in the range of seven to nine inches and more preferably eight inches. The band 12 then preferably tapers at each of a buckle end 22 and an opposite end 24 to a width in the range of one to five inches, preferably two to four inches, and more preferably ⅗ inches. The buckle end 22 may comprise a belt buckle, retention buckle, hook and loop fasteners known as VELCRO™, or other types of fastening means.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes that come within the meaning and range of equivalency of the claims are therefore intended to be embraced therein.

The invention claimed is:

1. A support belt assembly for a user for carrying a slab, the support belt assembly comprising:

(a) a belt for securing around a waist of a user, the belt including a first end having a fastener, a second end configured to receive the fastener and a middle portion having a midpoint intermediate the first end and the second end and arranged between the first and second ends the band having a top edge and a spaced bottom edge extending between the first end and the second end;

(b) a first strap having a first upper portion and an end portion, the end portion affixed to the first upper portion and forming a first terminal closed loop a first spacer portion intermediate to the first terminal closed loop and the bottom edge of the band, the first upper portion connected to the belt at a first folded region, the first folded region at a first anterior location of the belt;

(c) a second strap having a second upper portion and an end portion, the end portion affixed to the second upper portion forming a second terminal closed loop and a second spacer portion intermediate to the second terminal closed loop and the bottom edge of the band, the second upper portion connected to the belt at a second folded region, the second folded region at a second anterior location of the belt; and (d) a pincher having pivotally connected arms, first and second handles and first and second gripping surfaces, the handles moveable between open and closed positions to move the gripping surfaces between a receiving position and a clamping position, respectively, wherein the first handle is disposed within the first closed loop and the second handle is disposed within the second closed loop;

(e) each of the first and second straps locating corresponding first and second closed loops a first distance from the bottom edge of the band to cooperatively engage the first and second handle of the pincher in the receiving position of the gripping surface; and (f) each of the first and second straps locating corresponding first and second closed loops a second distance from the bottom edge of the band to cooperatively engage the first and second handle of the pincher in a clamping position of the gripping surface, the second distance being greater than the first distance, and each of the first and second straps disposed to locate the pincher ventrally with respect to the user, the support belt assembly bearing all the weight of the slab and being free of contact with the shoulders and arms of a user.

2. The support belt assembly for a user of claim 1, wherein the first and second straps are non-parallel and located between the first and second regions in both the receiving position and the clamping position.

3. The support belt assembly for a user of claim 2, wherein the first anterior location on the belt is disposed at a shorter distance from the midpoint of the band than the distance from the midpoint of the band to the second anterior location on the belt.

4. The support belt assembly of claim 2, wherein the first and second anterior locations on the belt are approximately equidistant from the midpoint of the belt.

5. The support belt assembly of claim 2, wherein the first and second terminal closed loops and the first and second spacer portions are operably below the waist of the user.

6. The support belt assembly of claim 1, wherein the first and second closed loops are each two inches in diameter.

7. The support belt assembly of claim 1 wherein the first and second gripping surfaces of the pincher are planar and the first and second handles extend parallel to the gripping surfaces.

8. The support belt assembly of claim 1 wherein the first and second straps are disposed at a predetermined angle between approximately 15 degrees and 90 degrees.

9. The support belt assembly of claim 1 wherein the first and second straps are disposed at a predetermined angle of approximately 45 degrees.

10. The support belt assembly of claim 1, wherein the end portion of each of the first and second straps is permanently affixed to the upper portion of each of the first and second straps.

11. A method comprising:

(a) securing a belt of a support belt assembly around a waist of a user, the belt including a first end having a fastener, a second end configured to receive the fastener, a top edge and a spaced bottom edge extending between the first end and the second end, the support belt assembly being free of contact with the shoulders of the user;

(b) locating a first strap having a first upper portion, a first end portion, the first end portion affixed to the first upper portion and forming a first terminal closed loop and a first spacer portion intermediate to the first terminal closed loop and the bottom edge of the band, the first upper portion connected to the belt at a first anterior location of the belt to locate the first terminal closed loop below the waist of the user;

(c) locating a second strap having a second upper portion, a second end portion, the second end portion affixed to the second upper portion and forming a second terminal closed loop and a second spacer portion intermediate to the second terminal closed loop and the bottom edge of the band, the second upper portion connected to the belt at a second anterior location of the belt to locate the second terminal closed loop below the waist of the user;

(d) locating a first handle of a first arm of a pincher having a second arm pivotally connected to the first arm and first and second planar gripping surfaces, the second arm having a second handle and the handles moveable between open and closed positions to move the gripping surfaces between a receiving position and a clamping position, in the first terminal loop to dispose the first handle parallel to the first gripping surface;

(e) locating the second handle of the pincher in the second terminal loop to dispose the second handle parallel to the second gripping surface;

(f) locating a portion of a slab between the first and second planar gripping surfaces; and (g) pivoting the first and second handles to grip the slab between the first and second gripping surfaces.

12. A support belt assembly for a user carrying a slab, the support belt assembly comprising:

(a) a belt for securing around a waist of a user, the belt having a first end, a second end, and a middle portion disposed between the first and second ends and having a midpoint, the belt having a top edge and a spaced bottom edge extending between the first end and the second end;

(b) a fastener for removably securing the first and second ends;

(c) a first strap proximate the first end of the belt, the first strap having an upper portion and an end portion, the end portion affixed to the upper portion and forming a first terminal closed loop and a first spacer portion intermediate to the first terminal closed loop and the bottom edge of the belt, the upper portion of the first strap connected to the belt at a first folded region a first distance from the midpoint at a first anterior location on the belt;

(d) a second strap proximate the second end of the belt, the first strap having an upper portion and an end portion, the end portion affixed to the upper portion and forming a second terminal closed loop and a second spacer portion intermediate to the second terminal closed loop and the bottom edge of the belt, the upper portion of the second strap connected to the belt at a second folded region a second distance from the midpoint at a second anterior location on the belt, the first distance being less than the second distance;

(e) a pincher having pivotally connected arms, first and second handles, and first and second gripping surfaces, the handles moveable between open and closed positions to move the gripping surfaces between a receiving position and a clamping position, respectively, wherein the first handle is disposed within the first closed loop and the second handle is disposed within the second closed loop;

(f) each of the first and second straps locating corresponding first and second closed loops a first distance from the bottom edge of the belt to cooperatively engage the first and second handle of the pincher in the receiving position of the gripping surface; and (g) each of the first and second straps locating corresponding first and second closed loops a second distance from the bottom edge of the belt to cooperatively engage the first and second handle of the pincher in a clamping position of the gripping surface, the second distance being greater than the first distance, the support belt assembly bearing all the weight of the slab and being free of contact with the shoulders and arms of a user.

13. The support belt assembly of claim 12, wherein the first and second straps are coupled to the belt at first and second regions, respectively, wherein the first and second straps are non-parallel and located between the first and second regions in both the receiving and clamping positions.

14. The support belt assembly of claim 12 wherein the first and second terminal closed loops and the first and second spacer portions are operably below the waist of the user during use.

15. The support belt assembly of claim 12, wherein the end portion of each of the first and second straps is permanently affixed to the upper portion of each of the first and second straps.

16. A method of using the support belt assembly of claim 1 comprising:

providing the support belt assembly as described in claim 1;

locating a portion of a slab between the first and second gripping surfaces;

and pivoting the first and second handles to grip the slab between the first and second gripping surfaces.

* * * * *